United States Patent [19]

Mertens

[11] Patent Number: 4,768,810

[45] Date of Patent: Sep. 6, 1988

[54] FANFOLDED TABLET OF A WEB WHICH IS SEPARABLE INTO SHEETS EACH BEARING A PRESSURE-SENSITIVE ADHESIVE PATTERN

[75] Inventor: Timothy A. Mertens, Cottage Grove, Minn.

[73] Assignee: Minnesota Mining and Manufacturing Company, Saint Paul, Minn.

[21] Appl. No.: 877,371

[22] Filed: Jun. 23, 1986

[51] Int. Cl.[4] ..... B41L 1/32; B32B 7/06

[52] U.S. Cl. ..... 282/12 A; 282/DIG. 2; 428/40; 428/43; 428/198; 428/202; 428/203; 428/126; 281/5

[58] Field of Search ..... 428/40, 43, 202, 194, 428/195, 126, 198, 203; 282/12 A, 12 R, DIG. 2; 281/5

[56] References Cited

U.S. PATENT DOCUMENTS

| | | | |
|---|---|---|---|
| 2,030,135 | 2/1936 | Carpenter | 24/67 |
| 2,552,664 | 5/1951 | Burdine | 154/53.5 |
| 3,033,702 | 5/1962 | Fenselau | 117/38 |
| 3,203,823 | 8/1965 | Grimes | 117/38 |
| 3,691,140 | 9/1972 | Silver | 260/78.5 |
| 3,857,731 | 12/1974 | Merrill, Jr. | 118/122 |
| 3,900,642 | 8/1975 | Michel | 428/40 |
| 4,416,392 | 11/1983 | Smith | 221/45 |
| 4,460,634 | 7/1984 | Hasegawa | 428/124 |

FOREIGN PATENT DOCUMENTS

| | | |
|---|---|---|
| 0012789 | 7/1980 | European Pat. Off. . |
| 1502143 | 2/1978 | United Kingdom . |
| 1594798 | 8/1981 | United Kingdom . |
| 2150883 | 7/1985 | United Kingdom . |

*Primary Examiner*—Alexander S. Thomas
*Attorney, Agent, or Firm*—Donald M. Sell; John C. Barnes

[57] ABSTRACT

A writing tablet is formed from a substantially continuous, fanfolded web of uniform width having transverse paths of weakness, along which the web can be torn evenly into individual sheets of uniform size. One face of the web bears a series of pressure-sensitive adhesive patterns, one pattern on each sheet, which pattern contacts the adhesive-bearing face of an adjacent sheet only in nonadhesive areas. The pressure-sensitive adhesive and nonadhesive areas are so prepared that each sheet can be cleanly peeled from the adjacent sheet without adhesive transfer, even after prolonged storage. After the tablet has been formed, its sheets can be conveniently and efficiently imprinted in a printer or copier and then returned to tablet form.

20 Claims, 2 Drawing Sheets

FANFOLDED TABLET OF A WEB WHICH IS SEPARABLE INTO SHEETS EACH BEARING A PRESSURE-SENSITIVE ADHESIVE PATTERN

BACKGROUND OF THE INVENTION

1. Field of the Invention

The invention concerns writing tablets, each sheet of which bears a pressure-sensitive adhesive pattern by which the sheet can be adhered to an object, either temporarily or permanently, depending upon the qualities of the pressure-sensitive adhesive.

2. Description of the Prior Art

An office supply item in widespread use is a tablet of individual paper sheets, each bearing a narrow band or stripe of low-tack pressure-sensitive adhesive by which the sheets can be temporarily adhered to documents or other articles, usually for message-bearing purposes. In the most popular of these tablets, every adhesive band extends along one side of the tablet. In another such tablet, the adhesive bands extend along alternating opposite sides of the tablet, thus creating a Z-stack as illustrated in U.S. Pat. No 4,416,392 (Smith). Tablets of each such form are currently being marketed under the trademark "Post-it" by the company to which this application is assigned. Useful low-tack adhesives based on tacky, elastomeric copolymer microspheres are disclosed in U.S. Pat. Nos. 3,691,140 (Silver) and 3,857,731 (Merrill et al.)

To make such a tablet using an aggressive pressure-sensitive adhesive would require a release coating on the nonadhesive, message-receiving face of each sheet, and such a coating inhibits the acceptance of inked messages. Even when the pressure-sensitive adhesive is low-tack, the underlying face of each sheet usually has a release coating to insure perfect removability after prolonged storage.

Some such tablets have a printed message and/or decoration on each sheet, but to do this mechanically has required printing of the sheetstock before the tablet is formed. In order to apply such printing after the tablet has been formed, it has been necessary to peel off and imprint each sheet separately, e.g., by temporarily adhering one or more sheets to a piece of paper and loading this into a typewriter or copier.

3. Other Prior Art

UK Patent Application No. GB 2,150,883A shows a "continuous blank form", e.g., a pin-drive paper web which can be automatically printed in a computer. After being printed, the form is designed to be torn apart into pieces that can be folded and sealed to form an envelope around the printing. Each piece has tracks of a "cold adhesive" such that a strong bond is formed when the tracks are pressed against each other, but the adhesive tracks do not adhere to bare paper. The adhesive tracks are aligned to contact each other upon folding, and upon doing so, it is said that "the letter cannot be opened without leaving traces". Although not illustrated, it is said that the continuous form can be kept in an accordion-like stack or a zig-zag pile (fanfolded) by offsetting the adhesive tracks so that they do not contact each other and hence do not inhibit unfolding. See page 2, lines 62–93, and the abstract on the cover sheet.

U.S Pat. No. 4,460,634 (Hasagawa) concerns an adhesive sheet which can be removably mounted onto a panel, wall or the like for display purposes. A typical adhesive display sheet as shown in FIG. 1 comprises circular adhesive pieces 2 which are made by "pasting an adhesive agent in selected areas on the rear face of adhesive sheet 1" (col. 3, lines 59–61). Circular nonadhesive plastic support pieces 3 are secured to the adhesive sheet 1 between adjacent adhesive pieces and preferably "have substantially the same thickness as the adhesive pieces 2" to enable the sheet 1 to be easily peeled off a panel or wall. As illustrated in FIG. 15, a similar sheet 1*a'* which carries a checkerboard of adhesive squares 2*a* and support portions 3 can be folded along line 9, because the adhesive squares 2*a* of each half of the sheet contact the support portions 3 of the other to permit the two halves to be peeled apart. The description of FIG. 15 concludes by stating that the folding line 9 may be replaced by a perforated line (col. 9, lines 20–21).

UK Patent Specification No. 1,594,798 shows a "continuous stationery envelope assembly" which is "divided into individual envelope lengths by transverse lines of cross perforations" (claim 1). At the periphery of each envelope is a band of hot melt or heat seal adhesive.

SUMMARY OF THE INVENTION

The invention provides what is believed to be the first tablet of sheets bearing a pressure-sensitive adhesive pattern, which sheets can be conveniently and efficiently imprinted in a printer or copier after the tablet has been formed. Even when that pattern is an aggressive pressure-sensitive adhesive, the face of each sheet which is to receive messages can be unadulterated, i.e., free from any coating which could inhibit the acceptance of inked messages. On the other hand, the message-receiving face of each sheet can be pre-imprinted, e.g., with a form or a decorative design, or can incorporate other features such as are known in the forms industry.

Briefly, the novel tablet comprises a substantially continuous, fanfolded web of uniform width that is periodically formed with transverse paths of weakness, along which paths the web can be torn evenly into individual sheets of uniform size. One face of the web bears a series of pressure-sensitive adhesive patterns, one pattern on each sheet, which pattern contacts the adhesive-bearing face of an adjacent sheet only in nonadhesive areas. The pressure-sensitive adhesive and nonadhesive areas are so prepared that each sheet can be cleanly peeled from the other sheet without adhesive transfer, even after prolonged storage.

By affording every sheet of the tablet with the same adhesive pattern, there is no need for some of the sheets to have an undesirable adhesive placement. Furthermore, the user knows where each sheet should be pressed to assure good adhesion.

In order to afford good contact between the pressure-sensitive adhesive patterns and objects to which they are attached, the nonadhesive areas should be recessed with respect to the adhesive patterns. This result is inherent when the nonadhesive areas are uncoated or have been impregnated with a release material. The same result is always achieved when the nonadhesive areas have release coatings, because the most useful low-adhesion or release coatings always are much thinner than are pressure-sensitive adhesive coatings. The thickness of the typical low-adhesion or release coating is less than one-third that of a typical pressure-sensitive adhesive coating.

In a typical tablet of the invention, each pressure-sensitive adhesive pattern may be a continuous, narrow band or stripe along the same side of every path of weakness so that in the fanfolded tablet, the adhesive band of one sheet adjacent a given path of weakness contacts the portion of the facing sheet on the opposite side of that path of weakness, and a nonadhesive area of said one sheet contacts the adhesive band of said facing sheet. In the resulting fanfold, adjacent paths of weakness lie at opposite sides of the tablet and, if they coincide with other paths of weakness, the paths of weakness may together form substantially flat sides of the tablet.

In another preferred tablet of the invention, the pressure-sensitive adhesive pattern forms a symmetrical series of spots, e.g., a checkerboard pattern. When such a pattern extends over substantially the entire surface of each sheet of the tablet, the sheet is less likely to be accidentally dislodged from objects to which it may be adhered.

When the pressure-sensitive adhesive patterns of the novel tablet are low-tack, the nonadhesive areas of adhesive-bearing face of the web can be untreated, although clean separation is better assured when a low-adhesion or release coating substantially covers the nonadhesive areas. On the other hand, an aggressive pressure-sensitive adhesive would require the nonadhesive areas of each sheet to bear a release coating unless the web is a material, or has been impregnated with a material, from which the adhesive readily releases.

The paths of weakness may be formed in any manner permitting the sheets to be torn apart evenly while allowing sufficient integrity so that the web does not spontaneously fall apart upon being fanfolded or imprinted. Suitable paths of weakness can be provided by perforations, crushing, chemical treatment, grooves formed by control-depth cuts, or the like.

In addition to the transverse paths of weakness, there may be additional paths of weakness to permit each sheet of the novel tablet to be torn evenly into smaller pieces. For example, a longitudinal path of weakness can allow each sheet to be separated into two pieces, one of which may bear an aggressive pressure-sensitive adhesive pattern and the other a low-tack pressure-sensitive adhesive pattern. Such a tablet can be used to apply permanent labels such as a mailing label having a readily removable portion that might serve as a receipt or record. When the web has detachable pin-drive edges, the transverse paths of weakness may either terminate at those detachable edges or extend across those edges.

To improve the adhesion to the web of the pressure-sensitive adhesive pattern, its application may be preceded by an adhesion-promoting treatment. When a release coating is to be applied to the nonadhesive areas of the adhesive bearing face of the web, the adhesion-promoting treatment preferably promotes the adhesion to the web of both the pressure-sensitive adhesive and the release coating.

In order to imprint sheets of the novel tablet after it has been formed, the web can be unfolded and fed into a printer such as a typewriter, after which it can either be again fanfolded, or individual sheets may be immediately torn off and put into use. Whether or not the pressure-sensitie adhesive is aggressive, the roll or rolls of the printer may be modified to enhance removal of the web.

The web may comprise paper such as the writing or bond paper commonly used in the above-mentioned "Post-It" pads. Instead of paper, the web may comprise plastic sheeting or ther imprintable material. Useful plastic sheeting includes cellulose acetate which can be transparent, thus enabling the adhesive-bearing sheets of the novel tablet to be applied to documents without obscuring material carried by the documents. A plastic or paper web may be a base for a stack of leaves such as a stack of carbonless paper. Those stacked leaves may be either discrete pieces, each equal in size to one sheet of the base web, or they may have the same length as the base web, in which event they should be formed with corresponding paths of weakness.

BRIEF DESCRIPTION OF THE DRAWING

In the drawing, all figures of which are schematic.

DESCRIPTION OF THE PREFERRED EMBODIMENTS

Figure 1:
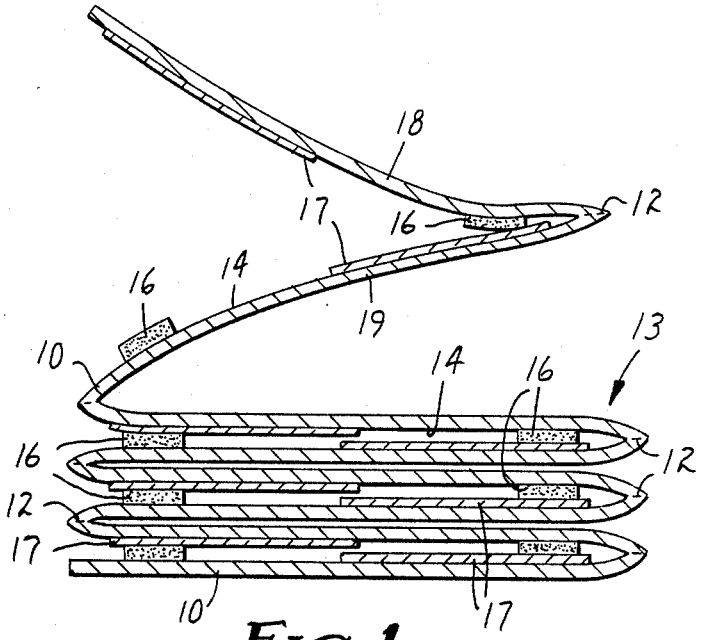
FIG. 1 is a central cross-sectional view through a fanfolded tablet embodying the present invention, showing the top sheet being peeled off.

Referring first to FIG. 1, a substantially continuous web of writing paper has been formed with transverse perforations 12 along which the web has been fanfolded to form the illustrated tablet 13. One face 14 of the web 10 bears a series of identical narrow bands 16 of pressure-sensitive adhesive, each extending across the full width of the web. The same face 14 also bears a series of somewhat wider areas 17 of low-adhesion or release material, each of which is contacted by one of the adhesive bands 16 when the web is fanfolded. The top sheet 18 of the fanfolded tablet 13 is shown being peeled off the underlying sheet 19, and when the adhesive band 16 of the top sheet has been separated and torn from the underlying sheet 19, the underlying sheet 19 then falls back to become the top sheet of the tablet until it is torn off.

In the tablet 13, the transverse perforations 12 coincide and together form substantially flat sides of the tablet.

Figure 2:
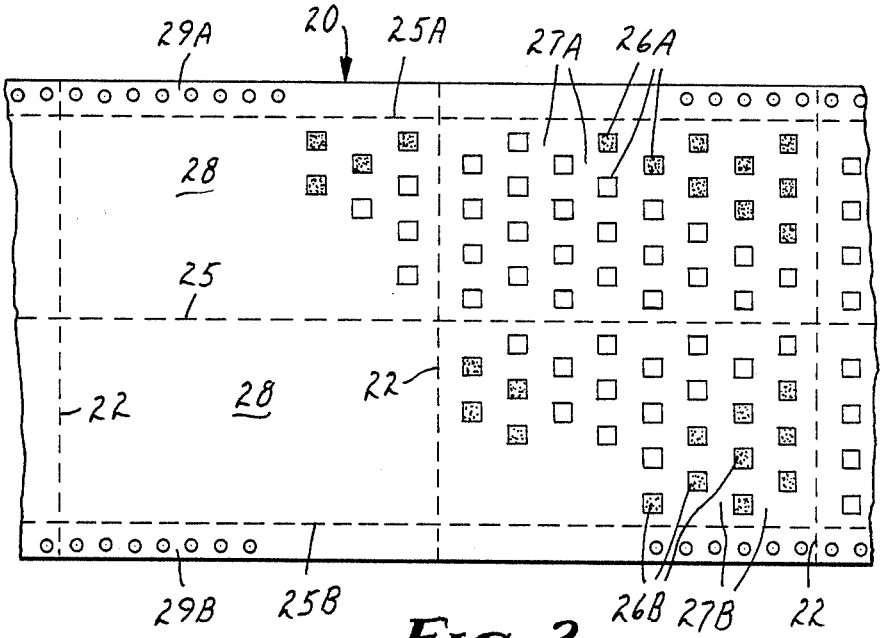
FIG. 2 is a fragmentary plan view showing the adhesive-bearing surface of a web useful for making a second fanfolded tablet of the invention.

In FIG. 2, a substantially continuous paper web 20 has transverse perforations 22 along which the web can be torn evenly into individual sheets 28, each of which bears the same pressure-sensitive adhesive pattern. On one side of a central longitudinal perforation 25 is a checkerboard pattern 26A of aggressive pressure-sensitive adhesive, and on the other side is a checkerboard pattern 26B of low-tack pressure-sensitive adhesive. Upon fanfolding the web 20 along perforations 22, the adhesive patterns 26A and 26B of each of the sheets 28 contact the adhesive-bearing face of the adjacent sheet only in slightly larger nonadhesive areas 27A and 27B. After removing the top sheet from a fanfolded tablet, that sheet can be torn evenly into two pieces along the central perforation 25, either before or after the sheet has been put to use. The web 20 includes a pair of detachable pin-drive edges 29A and 29B which can be cleanly torn away along longitudinal perforations 25A and 25B, respectively.

Figure 3:
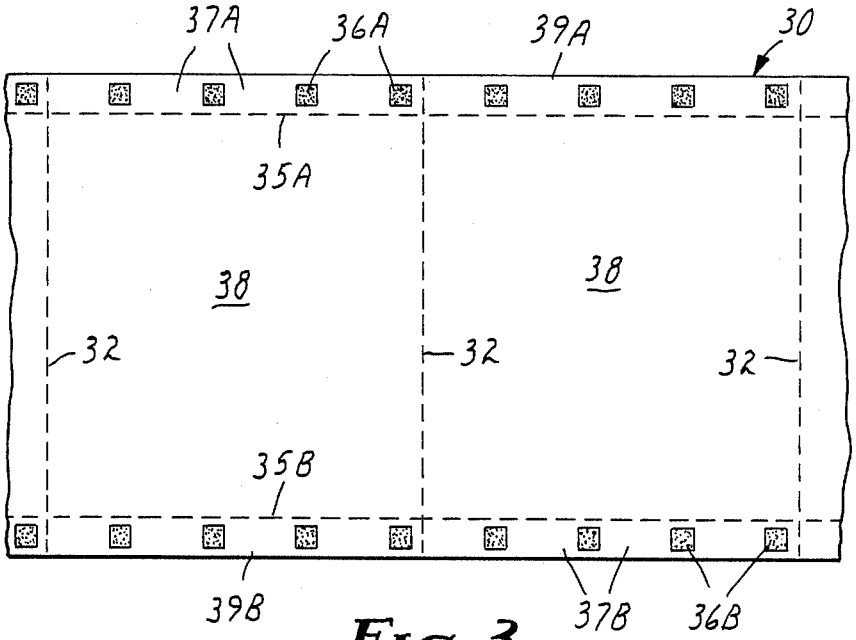
FIG. 3 is a fragmentary plan view showing the adhesive-bearing surface of a web useful for making a third fanfolded tablet of the invention.
Figure 4:
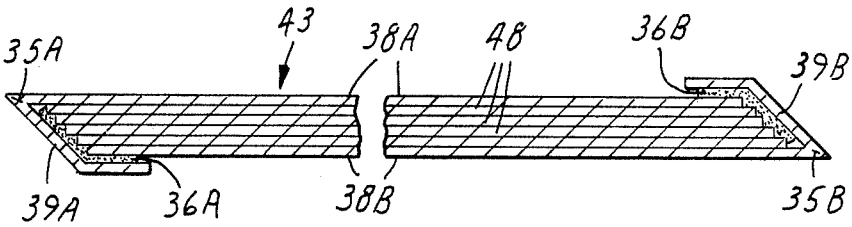
FIG. 4 is a diagrammatic vertical cross-sectional view showing a diverse use of two of the individual sheets of the tablet provided by the web of FIG. 3.

In FIG. 3, a substantially continuous paper web 30 has a pair of longitudinal perforations 35A and 35B defining detachable edges 39A and 39B, respectively. The web 30 can be torn evenly into individual sheets 38 along transverse perforations 32 that extend through those edges 39A and 39B. Within each of the detachable edges is a series of identical pressure-sensitive adhesive patterns of separated squares. Along one edge, those squares are a pattern 36A of aggressive pressure-sensitive adhesive, and along the other edge, a pattern 36B of low-tack pressure-sensitive adhesive. Upon fanfolding the web 30 to form a tablet, the adhesive patterns 36A and 36B of each of the sheets 38 contact the adhesive-bearing face of an adjacent sheet only in nonadhesive areas 37A and 37B provided by rectangular release areas, each slightly larger than one of the adhesive squares. After fanfolding the web 30 to provide a tablet, the top sheet can be peeled off and detached along a transverse perforation 32. Upon discarding the edge 39B, a sheet 38A bears a pattern 36A of aggressive pressure-sensitive adhesive along only one edge. That sheet 38A can be used as the top sheet of a tablet 43 comprising a stack of plain paper sheets 48 as illustrated in FIG. 4. By folding the edge 39A around the slightly staggered edges of the stacked sheets, the adhesive patterns 36A bind the plain paper sheets 48 together. By discarding the edge 39A from another of the adhesive-bearing sheets 38, the resulting sheet 38B can be bound into the tablet 43 as its bottom sheet and folded around the opposite ends of the sheets 48 to enhance the integrity of the tablet 43. Then upon temporarily peeling back the sheet 38B, the sheets 48 can be individually removed.

In the following examples, all parts are given by weight.

EXAMPLE 1

A low-tack pressure-sensitive adhesive was prepared from a suspension in organic solvent of 20 parts of the copolymer of 95% iso-octyl acrylate and 5% acrylic acid plus 80 parts of tacky, elastomeric copolymer microspheres ranging in diameter from about 10 to 150 micrometers. The microspheres were made as taught in U.S. Pat. No. 3,691,140 (Silver). Using a rotogravure, the suspension was coated onto a long web of tablet-grade writing paper in the pattern of FIG. 1 of the drawing, each band of adhesive being 1.27 cm in width and extending across the full 15 cm width of the web, there being a spacing of 7.0 cm between adjacent adhesive bands. This dried for 20 seconds at 120° C. to a thickness of about 50 micrometers. Then a silicone polymer release coating was applied in areas between the adhesive bands and dried to a thickness of about 1 micrometer. The paper web was then cut transversely to about one-half its depth to form individual sheets of uniform size, each sheet containing one adhesive band extending along one of its cuts of a nonadhesive release area adjacent its other cut. The paper web was then fanfolded to provide a tablet as illustrated in FIG. 1 of the drawing.

After applying a silicone polymer release coating to the roll of a computer printer, the web was fed from the fanfolded tablet into the printer, imprinted on its nonadhesive face, and returned to fanfolded form. Subsequently, individual sheets were evenly torn from the tablet and removably adhered to documents and other objects.

EXAMPLE 2

A fanfolded tablet identical to that of Example 1 was prepared except that the low-tack adhesive bands were replaced by aggressive pressure-sensitive adhesive bands comprising a copolymer of 95% iso-octyl acrylate and 5% acrylic acid. Its adhesive bearing web was fed from the fanfold into the same printer and surprisingly, in spite of the aggressive nature of the pressure-sensitive, the printer fed out the adhesive-bearing web without any sticking, whereupon the web was returned to fanfold form. Individual sheets were later evenly detached and put to use.

EXAMPLE 3

A tablet was prepared from an adhesive-bearing writing paper web as shown in FIG. 2 of the drawing, the adhesive squares 26A being the aggressive pressure-sensitive adhesive of Example 2 and the adhesive squares 26B being the low-tack pressure-sensitive adhesive of Example 1. After forming the tablet, its nonadhesive face was printed in the same computer printer. After individual sheets were torn from the printed tablet, they were applied to kraft packaging paper, from which only the portions bearing the low-tack adhesive could be removed without damage.

EXAMPLE 4

Tablet-grade writing paper was employed to provide a web as shown in FIG. 3 of the drawing. To do this, the aggressive pressure-sensitive adhesive used in Example 2 was coated onto a release liner which was then cut to lengths of 1.5 inches (4.8 cm) and widths (0.5 inch; 1.3 cm) equal to that of the detachable pin-drive edges of the writing paper. The lengths were applied to the left-hand detachable edge with their leading edges spaced 0.25, 3.75, and 7.25 inches (0.1, 1.5, and 2.9 cm) from transverse perforations of the web. Similar lengths of the low-tack pressure-sensitive adhesive of Example 1 were similarly applied to the right-hand detachable edge of the web. Then after masking the same face of the web between the detached edges, a silicone release coating was applied over the entire face. After the coating had dried, the strips of liner and the masking were removed, leaving pressure-sensitive adhesive patterns as illustrated in FIG. 3. The adhesive-bearing web was then fanfolded and later unfolded and fed into a printer. Unlike the previous examples, the adhesive patterns faced away from the printing platen and rollers.

After separating two letter-size sheets along the transverse perforations and tearing off the detachable right-hand edge from one sheet and the left-hand edge from the other, the two sheets were used as the top and bottom sheets in creating a tablet as illustrated in FIG. 4 and described above.

I claim:

1. A tablet comprising a substantially continuous, fanfolded web of uniform width that is periodically formed with transverse paths of weakness along which the web can be torn evenly into individual sheets of uniform size, one face of the web bearing a series of pressure-sensitive adhesive patterns, there being one pattern on each sheet which contacts and releasably adheres to the adhesive-bearing face of an adjacent sheet only in nonadhesive areas that are recessed with respect to the pressure-sensitive adhesive patterns, the pressure-sensitive adhesive and the nonadhesive areas being such that each sheet can be cleanly peeled from the tablet without adhesive transfer, even after prolonged storage.

2. A tablet as defined in claim 1 wherein adjacent paths of weakness lie at opposite sides of the tablet and coincide with other paths of weakness, together affording substantially flat sides for the tablet.

3. A tablet as defined in claim 1 wherein the pressure-sensitive adhesive is low-tack, and said nonadhesive areas are untreated.

4. A tablet as defined in claim 1 wherein the pressure-sensitive adhesive is low-tack and comprises tacky, elastomeric copolymer microspheres.

5. A tablet as defined in claim 1 wherein every sheet has the same pressure-sensitive adhesive pattern.

6. A tablet as defined in claim 5 wherein the pressure-sensitive adhesive patterns form a continuous narrow band along the same side of every path of weakness of the web.

7. A tablet as defined in claim 1 wherein each pressure-sensitive adhesive pattern forms a symmetrical series of spots.

8. A tablet as defined in claim 1 wherein the pressure-sensitive adhesive is aggressive and the nonadhesive areas bear a release coating.

9. A tablet as defined in claim 1 wherein the nonadhesive areas are uncoated.

10. A tablet as defined in claim 1 wherein the nonadhesive areas have been impregnated with a release material.

11. A tablet as defined in claim 1 having release coatings covering the nonadhesive areas.

12. A tablet as defined in claim 11 wherein the thickness of the coating in the nonadhesive areas is less than one-third that of the pressure-sensitive adhesive coating.

13. A tablet as defined in claim 1 wherein the web comprises paper.

14. A tablet as defined in claim 1 wherein the web comprises plastic.

15. A tablet as defined in claim 1 wherein the web is transparent.

16. A tablet as defined in claim 1 in combination with a stack of leaves of carbonless paper with the web being a base for said stack of leaves.

17. A combination as defined in claim 16 wherein the leaves of the stack are discrete pieces, each equal in size of one sheet of base web.

18. A combination as defined in claim 16 wherein the leaves of the stack have the same length as the base web and are formed with corresponding paths of weakness.

19. A tablet as defined in claim 1 wherein the web is formed with detachable pin-drive edges.

20. A tablet as defined in claim 1 wherein the paths of weakness are formed by perforations.

* * * * *